US010842182B2

(12) United States Patent
Pijnenburg et al.

(10) Patent No.: US 10,842,182 B2
(45) Date of Patent: Nov. 24, 2020

(54) METHOD FOR THE PRODUCTION OF HOMOGENIZED TOBACCO MATERIAL

(71) Applicant: PHILIP MORRIS PRODUCTS S.A., Neuchatel (CH)

(72) Inventors: Johannes Petrus Maria Pijnenburg, Neuchatel (CH); Stefan Lauenstein, Cormondreche (CH)

(73) Assignee: Philip Morris Products S.A., Neuchatel (CH)

( * ) Notice: Subject to any disclaimer, the term of this patent is extended or adjusted under 35 U.S.C. 154(b) by 142 days.

(21) Appl. No.: 16/097,859

(22) PCT Filed: May 25, 2017

(86) PCT No.: PCT/EP2017/062708
§ 371 (c)(1),
(2) Date: Oct. 31, 2018

(87) PCT Pub. No.: WO2017/203016
PCT Pub. Date: Nov. 30, 2017

(65) Prior Publication Data

US 2019/0133174 A1 May 9, 2019

(30) Foreign Application Priority Data

May 27, 2016 (EP) ..... 16171640

(51) Int. Cl.
*A24B 3/14* (2006.01)
*A24B 3/08* (2006.01)

(52) U.S. Cl.
CPC . *A24B 3/08* (2013.01); *A24B 3/14* (2013.01)

(58) Field of Classification Search
CPC ..... A24B 3/08; A24B 3/14
See application file for complete search history.

(56) References Cited

FOREIGN PATENT DOCUMENTS

| | | |
|---|---|---|
| DE | 10 2008 023251 | 11/2009 |
| EP | 0565360 | 6/2000 |
| WO | WO 94/10864 | 5/1994 |
| WO | WO 2016/050472 | 4/2016 |

OTHER PUBLICATIONS

PCT Search Report and Written Opinion for PCT/EP2017/062708 dated Sep. 15, 2017 (11 pages).

*Primary Examiner* — Eric Yaary
(74) *Attorney, Agent, or Firm* — Mueting Raasch Group

(57) ABSTRACT

The invention relates to a method for producing homogenized tobacco material, comprising the steps of: selecting a first target value for a first tobacco characteristic; separately grinding (102) different tobacco types so as to obtain a plurality of different ground tobacco powders; blending (104) at least two of the plurality of different ground tobacco powders so as to form a first tobacco powder blend; blending (104) at least two of the plurality of different ground tobacco powders so as to form a second tobacco powder blend; checking (1123) a value of the first tobacco characteristic in the first tobacco powder blend; if the value of the first characteristic of the first tobacco powder blend is different from the first target value, adding the second tobacco powder blend to the first tobacco powder blend in order to obtain a value of the first tobacco characteristic in a mixture of the first and the second tobacco powder blends different from the value of the first tobacco characteristic in the first tobacco powder blend; and adding (1129) the second tobacco powder blend while mixing the first tobacco powder blend.

18 Claims, 7 Drawing Sheets

METHOD FOR THE PRODUCTION OF HOMOGENIZED TOBACCO MATERIAL

This application is a U.S. National Stage Application of International Application No. PCT/EP2017/062708 filed May 25, 2017, which was published in English on Nov. 30, 2017, as International Publication No. WO 2017/203016 A1. International Application No. PCT/EP2017/062708 claims priority to European Application No. 16171640.2 filed May 27, 2016.

This invention relates to a process for producing homogenized tobacco material. In particular, the invention relates to a process for producing homogenized tobacco material for use in an aerosol-generating article such as, for example, a cigarette or a "heat-not-burn" type tobacco containing product.

Today, in the manufacture of tobacco products, besides tobacco leaves, also homogenized tobacco material is used. This homogenized tobacco material is typically manufactured from parts of the tobacco plant that are less suited for the production of cut filler, like, for example, tobacco stems or tobacco dust.

Typically, tobacco dust is created as a side product during the handling of the tobacco leaves during manufacture.

The most commonly used forms of homogenized tobacco material are reconstituted tobacco sheet and cast leaf. The process to form homogenized tobacco material sheets commonly comprises a step in which tobacco dust and a binder, are mixed to form a slurry. The slurry is then used to create a tobacco web. For example by casting a viscous slurry onto a moving metal belt to produce so called cast leaf. Alternatively, a slurry with low viscosity and high water content can be used to create reconstituted tobacco in a process that resembles paper-making. Once prepared, homogenized tobacco webs may be cut in a similar fashion as whole leaf tobacco to produce tobacco cut filler suitable for cigarettes and other smoking articles. The function of the homogenized tobacco for use in conventional cigarettes is substantially limited to physical properties of tobacco, such as filling power, resistance to draw, tobacco rod firmness and burn characteristics. This homogenized tobacco is typically not designed to have taste impact. A process for making such homogenized tobacco is for example disclosed in European Patent EP 0565360.

In an aerosol-generating article, an aerosol-forming substrate is for example heated to a relatively low temperature, in order to form an aerosol but prevent combustion of the tobacco material. Further, the tobacco present in the homogenized tobacco material is typically the only tobacco, or includes the majority of the tobacco, present in the homogenized tobacco material of such a so called "heat-not burn" aerosol-generating article. This means that the aerosol composition that is generated by such a "heat-not burn" aerosol-generating article is substantially only based on the homogenized tobacco material.

Therefore, it is important to have good control over the composition of the homogenized tobacco material, for the control for example, of the taste of the aerosol.

The same homogenized tobacco material could be used to produce "conventional" tobacco products, where the homogenized tobacco material is combusted.

The homogenized tobacco material is obtained grinding different types of tobacco to produce a tobacco powder blend. The aforementioned tobacco powder blend is made for example by grinding different kinds of whole tobacco leaves into powder.

This tobacco powder blend has preferably specific properties or characteristics regarding its composition, in particular regarding reducing sugar, nicotine and ammonia levels, as the composition of the homogenized tobacco material will determine the reducing sugar, nicotine and ammonia levels of the finished aerosol-generating article. Such levels depend on the intrinsic quality of the batch of leaves that are being ground. Being the homogenized tobacco material substantially the only source of tobacco in an aerosol-generating article, it is preferred to control at least one of these properties or characteristics.

In the production of "classical" smoking article, such as in cigarettes or cigars, where a tobacco blend is also used, the above mentioned levels are also preferably controlled. To do so, known prior art processes generally include a step of analysis of a sample of a batch of whole cured leaves used to create the tobacco material to be used in the finished product. In this analysis, for example, the level of the desired characteristic, such as for example the level of nicotine, or of ammonia, or of reducing sugars, or of others, of the whole cured leaves is determined. In case the characteristic level is outside of a desired pre-set range, different solutions could be implemented. For instance, tobacco leaves which, due to their position in the plant or their nature (for instance vertical veins have low nicotine level), have more, or less, of the desired characteristic level can be added to the analyzed cured leaves, so that the whole characteristic level of the total amount of tobacco is changed. The batch of cured leaves, including the added leaves, is mixed and re-tested to determine the new characteristic level on a new sample. This process is carried out until the wished characteristic level is reached by the batch of leaves.

Using such known processes and solutions of the prior art for the manufacturing process of the aforementioned tobacco powder used to form the homogenized tobacco material is difficult. Adjusting the level of any parameter or characteristic of each bale of tobacco leaves according to indicated known processes would be very long because bales of different tobacco types have to be checked and perhaps not even possible in some cases, as the above mentioned level of the characteristic of the resulting tobacco powder is dependent on the blend of the different kinds of tobacco which is normally performed to obtain the desired blend for the realization of the homogenized tobacco material.

On the other hand, blending the different kinds of whole tobacco leaves used to manufacture the tobacco powder and then adjusting the overall level of the desired parameter or characteristic of the whole blend of tobacco leaves would mean to create a specific blender for whole leaves. The construction of a specific apparatus would then be required.

There is therefore a need for a new method of preparing a homogenized tobacco material for the use in a heated aerosol-generating article type that is adapted to adjust a level of a characteristic of the tobacco blend, in particular in which it is possible to control and vary a characteristic level of the tobacco blend used in the homogenized tobacco material, such as for example a nicotine level, reducing sugar level or ammonia level.

According to a first aspect, the invention relates to a method of production of homogenized tobacco material, comprising the steps of: selecting a first target value for a first tobacco characteristic; separately grinding different tobacco types so as to obtain a plurality of different ground tobacco powders; blending at least two of the plurality of different ground tobacco powders so as to form a first tobacco powder blend; blending at least two of the plurality of different ground tobacco powders so as to form a second tobacco powder blend; and checking a value of said first tobacco characteristic in the first tobacco powder blend. If the value of the first characteristic of the first tobacco powder blend is different from the first target value, the method of the invention further includes the steps of adding the second tobacco powder blend to the first tobacco powder blend in order to obtain a value of the first tobacco characteristic in a mixture of the first and the second tobacco powder blend different from the value of said first tobacco characteristic in the first tobacco powder blends; and of adding the second tobacco powder blend while mixing the first tobacco powder blend.

As the tobacco present in the homogenized tobacco material constitutes substantially the majority of tobacco present in the aerosol-generating article, the impact on the characteristics of the aerosol, such as for example its flavour, derives predominantly from the homogenized tobacco material. According to the invention, therefore, the ingredients for the homogenized tobacco material are blended such that at least a characteristic of the resulting blended tobacco powder is known. This is a significant advantage over conventional reconstituted tobacco sheets, where the exact composition of the tobacco dust that is used for the preparation is not entirely known. The blending of the tobaccos for the production of the homogenized tobacco material therefore allows setting and meeting predetermined target values for certain characteristics of the resulting blend of different types of tobacco, such as, for example, the flavour characteristics. The starting material for the production of homogenized tobacco material for aerosol-generating article according to the invention is mostly tobacco leaf that has thus the same size and physical properties as the tobacco for the blending of cut filler that is tobacco leaves.

According to the invention, the check of the level or value of the desired characteristic of the tobacco blend—called first characteristic—is performed when the tobacco is in the powder state, and not at the leaves state as in the prior art. The method to produce a homogenized tobacco material according to the invention may be relatively efficient because during the mixing step two actions are performed at the same time: the different kinds of tobacco powder are mixed in order to form the blend and the desired value of the first characteristic of the tobacco powder blend is adjusted. Further, adjusting the value of the desired first characteristic of the tobacco powder blend when the tobacco is at the powder state allows having a strong predictability of the outcome also in subsequent homogenized tobacco material productions. When the tobacco powder blend is prepared according to the invention, a plurality of parameters of the tobacco powder blend may be known, including not only the value of the desired first characteristic but also other parameters, such as the mean size of the powder grain, the components of the blend, the weight of the blend, and others. Knowing all these parameters allows having a full control of the majority of the characteristics of the mixture, which can be easily reproduced, allowing a continuity in the flavor and taste of the homogenized tobacco material as experienced by the consumer of the aerosol-generating device.

The term "homogenized tobacco material" is used throughout the specification to encompass any tobacco material formed by the agglomeration of particles of tobacco material. Sheets or webs of homogenized tobacco are formed in the present invention by agglomerating particulate tobacco obtained by grinding or otherwise powdering of one or both of tobacco leaf lamina and tobacco leaf stems.

In addition, homogenized tobacco material may comprise a minor quantity of one or more of tobacco dust, tobacco fines, and other particulate tobacco by-products formed during the treating, handling and shipping of tobacco.

Homogenized tobacco material may comprise one or more intrinsic binders, one or more extrinsic binders, or a combination thereof to help agglomerate particles of tobacco. Homogenized tobacco material may comprise other additives including, but not limited to, tobacco and non-tobacco fibres, aerosol-formers, humectants, plasticisers, flavourants, fillers, aqueous and non-aqueous solvents, and combinations thereof.

When intended for use as an aerosol-forming substrate of a heater aerosol-generating article, it may be preferred that the homogenized tobacco has an aerosol-former content greater than about 5 percent on a dry weight basis.

Preferably, reconstituted tobacco for use in heated aerosol-generating articles may have an aerosol-former content of between about 5 percent and about 30 percent by weight on a dry weight basis.

In the present invention, the tobacco blend is preferably used to create a slurry, which is formed by tobacco lamina and stem of different tobacco types, which are properly blended. With the term "tobacco type" one of the different varieties of tobacco is meant. With respect to the present invention, these different tobacco types may be distinguished in three main groups of bright tobacco, dark tobacco and aromatic tobacco. The distinction between these three groups is based on the curing process the tobacco undergoes before it is further processed in a tobacco product.

Bright tobaccos are tobaccos with a generally large, light coloured leaves.

Throughout the specification, the term "bright tobacco" is used for tobaccos that have been flue cured. Examples for bright tobaccos are Chinese Flue-Cured, Flue-Cured Brazil, US Flue-Cured such as Virginia tobacco, Indian Flue-Cured, Flue-Cured from Tanzania or other African Flue Cured. Bright tobacco is characterized by a high sugar to nitrogen ratio. From a sensorial perspective, bright tobacco is a tobacco type which, after curing, is associated with a spicy and lively sensation. Bright tobaccos are considered to be tobaccos with a content of reducing sugars of between about 2.5 percent and about 20 percent of dry weight base of the leaf and a total ammonia content of less than about 0.12 percent of dry weight base of the leaf. Reducing sugars comprise for example glucose or fructose. Total ammonia comprises for example ammonia and ammonia salts.

Dark tobaccos are tobaccos with a generally large, dark coloured leaves.

Throughout the specification, the term "dark tobacco" is used for tobaccos that have been air cured. Additionally, dark tobaccos may be fermented. Tobaccos that are used mainly for chewing, snuff, cigar, and pipe blends are also included in this category. From a sensorial perspective, dark tobacco is a tobacco type which, after curing, is associated with a smoky, dark cigar type sensation. Dark tobacco is characterized by a low sugar to nitrogen ratio. Examples for dark tobacco are Burley Malawi or other African Burley, Dark Cured Brazil Galpao, Sun Cured or Air Cured Indonesian Kasturi. Dark tobaccos are considered to be tobaccos with a content of reducing sugars of less than about 5 percent of dry weight base of the leaf and a total ammonia content of up to about 0.5 percent of dry weight base of the leaf.

Aromatic tobaccos are tobaccos that often have small, light coloured leaves.

Throughout the specification, the term "aromatic tobacco" is used for other tobaccos that have a high aromatic content, for example a high content of essential oils. From a sensorial perspective, aromatic tobacco is a tobacco type which, after curing, is associated with spicy and aromatic sensation. Example for aromatic tobaccos are Greek Oriental, Oriental Turkey, semi-oriental tobacco but also Fire Cured, US Burley, such as Perique, Rustica, US Burley or Meriland.

Additionally, a tobacco blend may comprise so called filler tobaccos. Filler tobacco is not a specific tobacco type, but it includes tobacco types which are mostly used to complement the other tobacco types used in the blend and do not bring a specific characteristic aroma direction to the final product. Examples for filler tobaccos are stems, midrib or stalks of other tobacco types. A specific example may be flue cured stems of Flue Cured Brazil lower stalk.

Within each type of tobaccos, the tobacco leaves are further graded for example with respect to origin, position in the plant, colour, surface texture, size and shape. These and other characteristics of the tobacco leaves are used to form a tobacco blend. A blend of tobacco is a mixture of tobaccos belonging to the same or different types such that the tobacco blend has an agglomerated specific characteristic. This characteristic can be for example a unique taste or a specific aerosol composition when heated or burned. A blend comprises specific tobacco types and grades in a given proportion one with respect to the other.

According to the invention, different grades within the same tobacco type may be cross-blended to reduce the variability of each blend component. According to the invention, the different tobacco types and grades may be selected in order to realize a desired blend having at least a specific predetermined characteristic.

For example, the blend may have a first target value of the reducing sugars, total ammonia, or total alkaloids per dry weight base of the homogenized tobacco material. Total alkaloids are for example nicotine and the minor alkaloids including nornicotine, anatabine, anabasine and myosmine.

The various tobacco types are in generally available in lamina and stems. In order to produce a tobacco mixture for a homogenized tobacco material, the selected tobacco types have to be ground in order to achieve a proper tobacco size, for example a tobacco size which is suitable for forming a slurry.

According to the invention, the various tobacco types to be mixed to form the blend are ground separately one from the other, that is, a plurality of "tobacco powders", a powder for each tobacco type, is rendered available at the end of the grinding step.

After this grinding step, in which a plurality of tobacco powders are formed, a first blending is performed. The first blend is made taking into account preferably both the sensorial characteristics of the finished product, that is, which smoking sensation is desired to convey to the consumer, and also in order to meet the target value of the desired first characteristic of the tobacco powder blend. In other words, the blend is preferably formed taking already into consideration the desired first target value of the characteristic to be achieved.

The blending of different tobacco types selected according to the invention is performed after the grinding, that is, the step of blending follows the step of grinding. This allows inline blending at a single production facility. Further, an intermediate boxing and storing process of blended tobacco leafs or strips is not required. Advantageously, the selected tobacco powders can be delivered in standard shipping crates for tobacco leafs to the facility in which the ground tobacco particles are manufactured. At the exit of the facility in which the ground tobacco particles are manufactured, the coarsely ground tobacco particles can be transported inline to the mixing machinery. Preferably, the mixing and further casting machinery are at the same location.

Thus, in this blending step, the first tobacco powder blend is formed. This first tobacco powder blend has a plurality of characteristics. One of these characteristics—called first characteristic—is the one for which the first target value has been pre-determined. Thus, the value of this first characteristic is checked in the first tobacco powder blend after its formation to see whether it matches or not the desired first target value.

If the value of the first characteristic in the first tobacco powder blend as formed in the first mixing step is equal or substantially equal to, that is, it is within the tolerance ranges of, the first target value, then preferably a slurry preparation follows, adding to the first tobacco powder blend the other slurry ingredients, such as a binder, an aerosol-former, water, etc.

If the value of the first characteristic, as measured in the first tobacco powder blend, is different from the desired target value, then a "correction action" is performed. A further tobacco powder blend, called second tobacco powder blend, which is also a blend of different ground tobacco types, is added to the first tobacco powder blend. This second tobacco powder blend—if properly formed—changes the overall value of the first characteristic in the mixture of the first and second tobacco powder blend. The second tobacco powder blend has a different value of the first characteristic from the value of the first characteristic in the first tobacco powder blend. Therefore, when the first and the second powder blends are mixed, the resulting value of the first characteristic is different from both the value of the first characteristic in the first tobacco powder blend and the value of the first characteristic in the second tobacco powder blend.

The addition of the second tobacco powder blend is performed while the tobacco powder blend is mixed. At the beginning, only the first tobacco powder blend is mixed, and while the second tobacco powder blend is added, the mixing preferably continues so that a homogeneous mixture is obtained.

The addition of the second tobacco powder blend may take place when the first tobacco powder blend is already in a slurry, that is, it is already in a liquid mixture. The first tobacco powder blend may be mixed with other slurry ingredients, such as pulp, which contains water, and then the second tobacco powder blend may be added to the already formed slurry to modify the first characteristic present in the slurry. The mixing of the first tobacco powder blend taking place when the second tobacco powder blend is added indicates the mixing of the slurry containing the first tobacco powder blend while the second tobacco powder blend is added to the slurry.

The characteristics of the mixture, including the first characteristic, are easily reproducible because several characteristics of the two tobacco powder blends are known. For example, the size of the tobacco powders of the first and second tobacco powder blends is known. Further, the weights and the ratio among the weights of the first and second tobacco powder blends are known. Therefore, if a given value of the first characteristic is desired, such value can be easily reproducible in a further batch for the production of a further tobacco mixture.

If the value of the first characteristic had been measured in the tobacco when still in whole leaves, so that all bales of the different tobacco types forming the blend had to be analysed, a different resulting value of the first characteristic in the first tobacco powder blend may have been obtained, because the various proportions of such first characteristic at the leaf stage might be different from the proportions of the same characteristic at the powder stage. Further, adjusting the value of the first characteristic in each bale of tobacco in whole leaves is a very lengthy process and in addition the end result can be altered because of the blending of various tobacco types. Adding to a first tobacco blend a second tobacco blend allows to easily modify the value of the first characteristic while mixing, without the need of checking the value of such first characteristic in all different tobacco types used to form the blend.

Further, in a single step of the method, both a homogeneous blend is formed due to the mixing and an adjustment of the first characteristic is performed.

Controlling at least a first characteristic of the tobacco in the blend, by means of selecting at least a target value, may allow controlling at least some of the compounds present in the aerosol of the resulting aerosol-forming article where the tobacco blend is used. This means that the aroma or chemical characteristics which depend on the tobacco first characteristic are, to some extent, foreseeable and reproducible. The homogenized tobacco material has therefore for example a specific or "flavour" or a reproducible characteristic that defines the homogenized tobacco material itself, similar to how a specific blend characterizes a combustible aerosol-generating article, such as a cigarette.

Alternatively or in addition, the selection of the first characteristic may influence the control of a characteristic of the homogenized tobacco material which does not affect the aroma of flavour, but the way in which it can be processed. It has been found that the control of certain tobacco characteristics not only influences, to some extent, the characteristics of the aerosol, but also the characteristics of the homogenized tobacco material during its processing to obtain the final product. That is to say, the first characteristic of the tobacco present in the tobacco blend can be so selected that certain characteristics of the homogenized tobacco material are enhanced or suppressed depending on the type of processing and desired effects and outcome.

Preferably, said second tobacco powder blend has a value of the first characteristic different from the value of the first characteristic in the first tobacco powder blend.

Preferably, the step of modifying a value of the first tobacco characteristic in the mixture includes bringing the value of the first tobacco characteristic in the mixture of the first and the second tobacco powder blends near the first target value. If a first target value of the first tobacco characteristic is desired, a second tobacco powder blend is added to the first tobacco powder blend, such second tobacco powder blend having a value of the first characteristic which can change "in the right direction" the value of the first characteristic of the first tobacco mixture.

More preferably, if the value of the first characteristic of the first tobacco powder blend is higher than the first target value, the method comprises the step of adding a second tobacco blend having a first characteristic value lower than said first target value; or if the value of the first characteristic of the first tobacco powder blend is lower than the first target value, the method comprises the step of adding a second tobacco blend having a first characteristic value higher than said first target value. Thus, the value of the first characteristic of the mixture of the two tobacco blends can be easily changed. Knowing the value of the first characteristic of the first tobacco blend, a second tobacco blend having a value of the first characteristic also different from the first target value, but in the opposite excess direction, is preferably added, so that its addition brings the value of the first characteristic of the mixture of the first and second tobacco powder blend close to the first target value.

Preferably, said first tobacco characteristic is the amount of reducing sugars, total alkaloids or total ammonia in dry weight basis of the total amount of tobacco present within the homogenized tobacco material. More preferably, among the total alkaloids, the first tobacco characteristic is the amount of nicotine in dry weight basis of the total amount of tobacco present within the homogenized tobacco material.

Reducing sugars may be an indicator for the level of different other compounds in the tobacco such as amino acids. As specific amino-acids may influence the level of certain aerosol constituent, the reduced sugar may be an indirect indicator of certain aerosol constituent. A very high content of reducing sugars in tobacco may be undesirable as it imparts to the aerosol an acidic character.

Reducing sugars may increase moisture content in an aerosol and so act as an emollient. The ratio of sugar to alkaloids can be an indicator of a balance of opposing effects and thus serve as a good aerosol quality indicator. A high ratio may tend to indicate mildness and smoothness while a very low ratio may be indicative of a harsh aerosol. If the ratio is too high, it may indicate that the tobacco is considered too mild. A high sugar content combined with a moderate alkaloid content is particularly preferred feature in an aerosol of an aerosol-generating article. A target value for reducing sugars is preferably between about 8 percent and about 18 percent in dry weight basis of the total amount of tobacco present within the homogenized tobacco material. It has been found that this selected target value of the amount of reducing sugars gives a pleasant aroma to the aerosol. Further, it has been found that this selected target value of the amount of reducing sugars enhances the plasticity of the homogenized tobacco material during processing.

During the production of aerosol generating articles comprising homogenized tobacco material from a homogenized tobacco material web, the homogenized tobacco web is typically required to withstand some physical handling like for example, wetting, conveying, drying and cutting. It would be therefore desirable to provide homogenized tobacco web that is adapted to withstand such handling with no or minimal impact on the quality of the final tobacco material. In particular, it would be desirable, that the homogenized tobacco material web shows little complete or partial ripping. A ripped homogenized tobacco web could lead to the loss of tobacco material during manufacture. Also, a partially or completely ripped homogenized tobacco web may lead to machine downtime and waste during machine stoppage and ramp up. Therefore, on one hand the homogenized tobacco material needs to be very homogeneous to avoid defects and tears during the production, and on the other hand it needs to have a tensile strength high enough to withstand the forces acting on the homogenized tobacco material during the processing.

Accordingly, the characteristic of plasticity, which means a rather high tensile strength, is an important aspect for avoiding machine stoppage and increasing the production yield. According to the invention, this aspect can be advantageously controlled by targeting a predetermined value for the reducing sugars that are present in the blend. In summary, it has been found that the amount of reducing sugars not only impact on the flavor of the aerosol, but also on the quality of the homogenized tobacco material when cast and processed.

A further target value, either the amount of total ammonia or total alkaloids, is preferably selected according to the invention. The total alkaloids are an indication of the amount of nicotine in the aerosol. Therefore, controlling the amount of total alkaloids in the tobacco allows controlling the amount of nicotine in the aerosol formed and inhaled while using the aerosol-generating article.

The total ammonia may be, to some extent, an indicator of the total ammonia in the aerosol. Advantageously, said second tobacco characteristic is total alkaloids and said second target value is comprised between about 0.5 percent and about 3.8 percent in dry weight basis of the total amount of tobacco present within the homogenized tobacco material. Preferably, the total alkaloid target value is comprised between about 1.5 percent and about 3.5 percent in dry weight basis of the total amount of tobacco present within the homogenized tobacco material. Nicotine is an alkaloid, thus controlling the amount of total alkaloids in turn may control the amount of nicotine in the homogenized tobacco material. Preferably, said second tobacco characteristic is total ammonia and said second target value is below about 0.2 percent in dry weight basis of the total amount of tobacco present within the homogenized tobacco material.

Preferably, the total ammonia content is kept as low as possible. The control of total ammonia in the blend is linked, so some extent, to the control of the chemistry composition of the aerosol delivered when the homogenized tobacco material is in use in an aerosol-generating article. In this way the nicotine delivery in the aerosol is, to some extent, predictable and reproducible.

Nicotine is an important parameter in aerosol generating articles. The value of nicotine determines for example the classification of the aerosol generating article itself. It also strongly contributes on the flavor or taste of the aerosol generating article. Therefore, it is generally desired to control its value. For example, the nicotine range maybe from 0.01% to 7% or from 1% to 2% in dry weight basis of the tobacco powder.

Preferably, the method of the invention comprises checking a value of the first tobacco characteristic after the addition of said second tobacco powder blend, and, if the value of the first tobacco characteristic of the mixture of the first and the second tobacco powder blends is within a tolerance range around the first target value, it also includes forming a slurry comprising the mixture; and forming a sheet of homogenous tobacco material from the slurry. If the mixture has the desired value of the first characteristic, that is, the tobacco powder present in the mixture of the first and second powder tobacco blend has reached the target value of the first characteristic, then from this amount of tobacco powder present in the mixture a slurry is formed, which is then used to form a homogenized tobacco sheet, for example by means of a casting step.

Preferably, adding the second tobacco powder blend includes adding a second tobacco powder blend including the same tobacco types in substantially the same proportions as in the first tobacco powder blend. Preferably, the blend of the second tobacco powder blend is preferably the same as the blend of the first tobacco powder blend. Although the blends can be the same, that is, for both first and second tobacco powder blends, the same types of tobacco in the same proportions have been used, the value of the first characteristic between the two blends can be different. As said, within the same tobacco type, the value of the first characteristic may differ, depending for example on the grade, on the position of the leaves in the plant, etcetera. Preferably the first and second tobacco powder blends are the same in tobacco types and proportions of the same, so that, with the addition of the second tobacco blend, the blend itself of the mixture is not changed, that is, the tobacco types and the proportions in which those tobacco types are present in the mixture do not change with the addition of the second tobacco powder blend to the first tobacco powder blend.

Preferably, the selection of the second tobacco powder blend and the quantity of it to be added to the first tobacco powder blend is done by mean calculation.

As said, preferably both the first and the second powder tobacco blends are formed by the same blend, that is, they both include the same tobacco types in the same proportions. Preferably, however they differ in their value of the first characteristic, for example their value of the first characteristic might be higher or lower than the target value. In order to determine which second tobacco powder blend among the available tobacco powder blends and how much of it has to be added to the first tobacco powder blend, preferably the following calculation is performed:

Final desired value of the first characteristic in the mixture=((value of the first characteristic in the first tobacco powder blend in the mixer)×(quantity of the first tobacco powder blend in the mixer in kg)+(value of the first characteristic in the second tobacco powder blend stored)×(quantity of the second tobacco powder blend stored and added in kg))/(quantity of the first tobacco powder blend in the mixer+quantity of the second tobacco powder blend stored and added)

The advantage of such calculation is that quite straightforward and predictable value behavior could be expected in the mixer, allowing a fast adjustment of the checked value of the first characteristic.

Preferably, after the addition of the second tobacco powder blend and the mixing, the value of the first characteristic in the mixture of the first and second tobacco powder blend is checked.

Preferably, the step of grinding different tobacco types so as to obtain a plurality of different ground tobacco powders includes coarse grinding different tobacco types so as to obtain a plurality of different coarse ground tobacco powder having a first mean powder size; and fine grinding the mixture of the first tobacco powder blend and the second tobacco powder blend so as to obtain the mixture of the first and the second tobacco powder blend having a second mean powder size smaller than the first mean powder size.

In order to minimize the energy used during the grinding phase, according to the invention, the grinding phase is divided into two steps. According to the invention, the coarse grinding step comprises grinding tobacco strips into a small size while at the same time the cell structure of the tobacco remains preferably substantially undamaged. Thus, the coarsely ground tobacco particles remain substantially dry. This is advantageous as the dry tobacco particles can be handled easily, for example for storing, blending and other subsequent processes. It has been found that, due to the inclusion of the coarse grinding step, the energy consumption in the fine grinding step can be advantageously reduced by about 30 percent. This reduction in energy consumption in the fine grinding step is therefore available to increase the possible throughput through the fine grinding step when the energy consumption is kept at the same level as without the coarse grinding.

Advantageously, this also allows decreasing the cost of production as less sophisticated machinery needs to be utilized to manufacture the coarse ground tobacco particles than is required for the manufacture of fine ground tobacco powder.

Thus, in this first grinding step of the method of the invention, the tobacco is coarse ground, that is, it is reduced to a particle size in which the cells of the tobacco are on average not broken or destroyed. Advantageously, at this stage, the resulting coarse ground tobacco stays dry, such that any viscous or sticky behaviour of the resulting coarse ground tobacco is avoided.

After this first, coarse grinding, step, in an additional grinding step the tobacco is ground into a tobacco powder with a mean particle size which is suitable for the formation of a slurry. In this second grinding step, the cells of the tobacco are to some extent or completely destroyed.

By reducing the tobacco powder mean size, less binder may be required to form the homogenized tobacco webs described herein. It is also believed that by fine grinding the tobacco to a finer powder size, substances within the tobacco cell can be released easier from the tobacco cells, such as for example pectin, nicotine, essential oils and other flavours.

Preferably, the coarse grinding of the tobacco can be done in parallel, for example a process line for each tobacco type used in the blend. Alternatively, coarse grinding of the tobacco can be done in series, that is one tobacco type after the other. The first embodiment is preferred in case the different tobacco types need a different processing during the coarse grinding.

Preferably, before the step of separately grinding different tobacco types, the method of the invention includes: separately shredding said different tobacco types so as to obtain a plurality of different tobacco strips having a third mean size. More preferably, the first mean size is smaller than said third mean size.

Dividing the tobacco particle size reduction into a plurality of separated steps, further reduces the overall energy consumption during each individual reduction step. Therefore, preferably, also the step of grinding the tobacco from the lamina and stem size to a particle size having the first mean size is performed in two sub-steps, a first shredding step where the tobacco is shredded up to a mean size of few centimetres and then the coarse grinding step up to the desired first mean size.

Preferably, the first mean powder size is comprised between about 300 microns and about 1200 microns. At this size, preferably the tobacco cells are still undamaged. In particular, at this size, the tobacco particles remain essentially dry and non-sticky. The amount of energy that is allocated to the fine grinding process is inverse proportional to the particle size. That is, the smaller the size of the after the particles at the coarse grinding stage, the more energy can is allocated to the coarse grinding process. Accordingly, the amount of energy that is required for the subsequent fine grinding process may be reduced.

For the fine grinding, a sieve or preferably a mill classifier may be used.

Preferably, the second mean powder size is comprised between about 50 microns and 150 microns. The second mean size represents the size at which the tobacco cells are at least in part destroyed by the grinding. Moreover, the slurry obtained using the powder of tobacco having this second mean size is smooth and uniform.

Preferably, wherein an amount of the mixture of the first and second tobacco powder blend is comprised between about 20 percent and about 93 percent in dry weight basis of the homogenized tobacco material. More preferably, the blended tobacco powder in the mixture comprises between about 50 percent and about 100 percent of the total amount of tobacco comprised within the homogenized tobacco material. The tobacco blend substantially represents the totality or at least the majority of the tobacco present in the homogenized tobacco material. Controlling the characteristics of the tobaccos forming the tobacco blend means controlling the characteristics of at least the majority of the tobacco in the homogenized tobacco material. A proper selection of the target values of the identified tobacco characteristics allows a control of the characteristics of the aerosol formed when the homogenized tobacco material is used as an aerosol former and a control of the homogenized tobacco material production process, due to the fact that the blend indeed contains most of the tobacco of the homogenized tobacco material.

Preferably, the steps of: blending the different ground tobacco powders so as to form a first tobacco powder blend and mixing the first tobacco powder blend include: inserting the different ground tobacco powders of different tobacco types into a mixer to form the first tobacco powder blend; checking a level reached by the first tobacco powder blend in the mixer; and, if the level of the first tobacco powder blend in the mixer is above a threshold level, removing part of the first powder tobacco blend from the mixer before adding the second tobacco powder blend.

This checking of the level of tobacco powder blend in the mixer may be performed either when the slurry is produced in batches, that is, when the slurry is produced in given quantities per unit time, or on line. The slurry batch is then further processed and a time gap is present between two different batches production. The on line slurry production is a process in which the slurry is continuously produced without interruptions.

Preferably, the method according to the invention includes the step of storing the first tobacco powder blend if a second tobacco powder blend having a proper value of the first characteristic to modify the value of the first tobacco characteristic which has been checked in the first tobacco powder blend in a mixture of the first and the second tobacco powder blends is not available. In case such a second tobacco powder blend is not available, that is, if there is not an additional tobacco blend that may vary the value of the first characteristic in the resulting mixture in a proper way, the mixture of the two blends is not formed because it would not have the desired properties. The first tobacco powder blend is then stored and preferably kept until a second tobacco powder blend having the desired value of the characteristic becomes available.

Advantageously, the method comprises the step of drying the sheet of homogeneous tobacco material. A web or sheet of homogenized tobacco material is preferably formed by a casting process of the type generally comprising casting a slurry prepared including the blend of tobacco powder above described on a support surface. Preferably, the cast tobacco web is then dried to form a sheet of homogenized tobacco material and it is then removed from the support surface. Preferably, the moisture of said cast tobacco web at casting is between about 60 percent and about 80 percent. Preferably, the method for production of a homogenized tobacco material comprises the step of drying said cast tobacco web and winding said cast tobacco web. Preferably, the moisture of said cast tobacco web at winding is between about 7 percent and about 15 percent of dry weight of the tobacco material web. Preferably, the moisture of said homogenized tobacco web at winding is between about 8 percent and about 12 percent of dry weight of the homogenized tobacco web.

Advantageously, the method of the invention comprises: detecting the presence of possible metal objects. The tobacco bales may include foreign elements or objects therewithin. Some foreign elements may be crushed during grinding, however metal element may not be crushed and may even damage the grinder or mill used for grinding. Therefore, it is preferred that these metal elements are removed, more preferably automatically, for example by means of one or more magnets or a metal detector associated with a flap or a combination of both.

Preferably, the step of mixing the first and the second powder tobacco blends includes mixing the first and the second powder tobacco blend for a time interval comprised between about 5 minutes and about 480 minutes. An important characteristic of the homogenized tobacco material which is produced with the tobacco mixture is its homogeneity. A homogenized tobacco sheet that is not very homogeneous includes generally several defects that leads to an unsatisfactory final product, which has to be discarded because it does not lie within the desired specification. Therefore, preferably the tobacco mixture is mixed until the desired homogeneity is achieved. The mixing time depends, among others, on the size of the tobacco powder, on the type of tobacco present in the blend and on the desired characteristics of the resulting homogenized tobacco sheet.

The control above described, where during the mixing the value of a first characteristic is checked and, if not equal to a target value, an adjustment process takes place, can be repeated with other tobacco characteristics. In this way, a plurality of target values may be set, such as a first, a second, and so on target value, and during the mixing the values of these target values are checked. In order to correct these values if they are not identical to the target ones, different additional blends can be introduced in the mixer.

Preferably, therefore, a plurality of additional tobacco powder blends are stored.

Each different tobacco powder blend of the plurality is realized using the same tobacco types in the same proportions, that is, it includes the same blend, but has one of the various characteristics which is not equal to one of the target values. That is, the tobacco powder blends stored to stabilize upcoming first tobacco powder blends batches are the ones which have only one characteristic value different from the pre-set target values.

If a tobacco powder blend is present which has more than one value of a characteristic different from the target values, it is also stored but it is mixed with other blends using other stored tobacco powders of the same blend till it reaches a single characteristic out of the desired ones.

Specific embodiments will be further described, by way of example only, with reference to the accompanying drawings in which.

Figure 2:
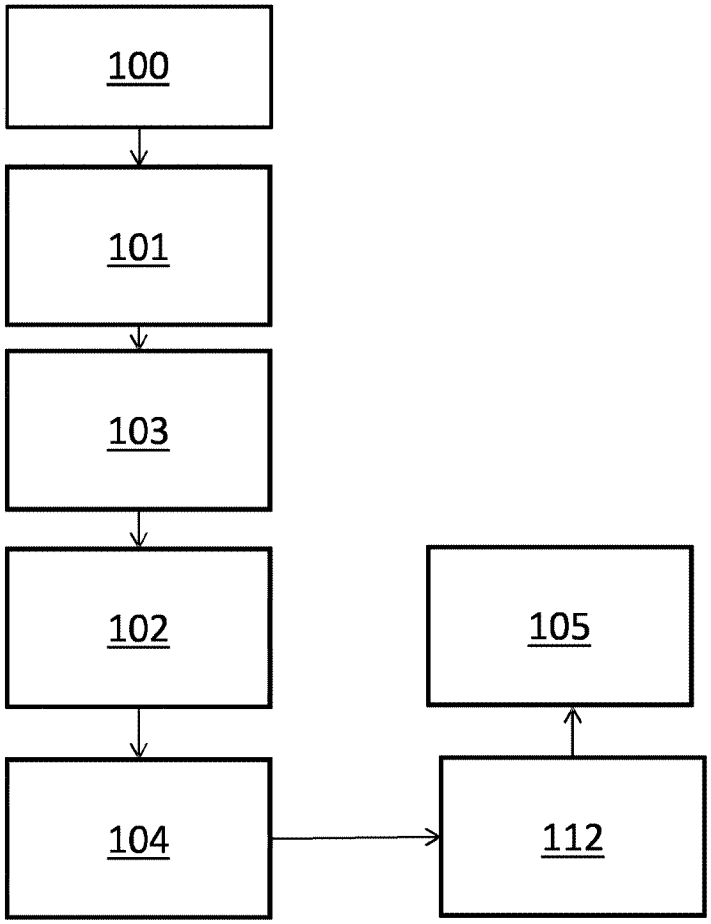
FIG. 2 shows a block diagram of a variant of the method of FIG. 1.
Figure 1:
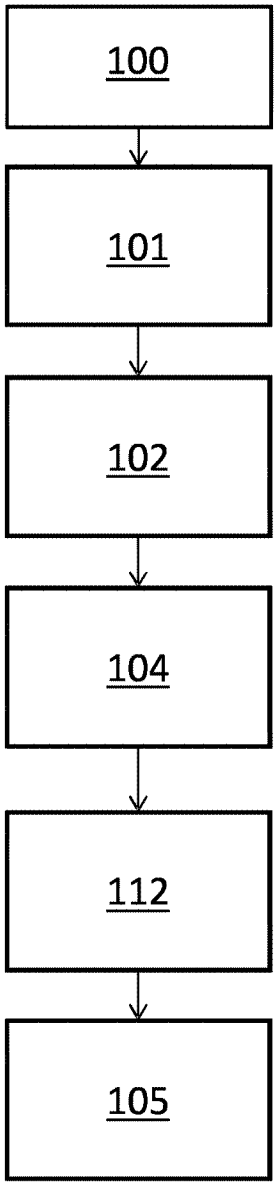
FIG. 1 shows a flow diagram of a method to produce slurry for homogenized tobacco material according to the invention.

With initial reference to FIGS. 1 and 2, a method for the production of a tobacco mixture according to the present invention is represented. The first step of the method of the invention is the selection 100 of the tobacco types to be used in the tobacco blend for producing the homogenized tobacco material. Tobacco types used in the present method are for example bright tobacco, dark tobacco, aromatic tobacco and filler tobacco.

Only the selected tobacco types intended to be production of the used for the homogenized tobacco material undergo the processing according to following steps of the method of the invention.

The method includes a further step 101 in which the selected tobacco is laid down. This step may comprise checking the tobacco integrity, such as grade and quantity, which can be for example verified by a bar code reader for product tracking and traceability. After harvesting and curing, the leaf of tobacco is given a grade, which describes the stalk position, quality, and colour.

Further, the lay down step 101 might also include, in case the tobacco is shipped to the manufacturing premises for the production of the homogenized tobacco material, de-boxing or case opening of the tobacco boxes. The de-boxed tobacco is then preferably fed to a weighing station in order to weight the same.

Moreover, the tobacco lay down step 101 may include bale slicing, if needed, as the tobacco leaves are normally transported in bales when boxed and shipped.

The tobacco bales are separated depending on the tobacco type. For example there may be a processing line for each tobacco type. Therefore, the following steps are performed for each tobacco type, as detailed below. These steps may be performed subsequently per type such that only one production line is required. Alternatively, the different tobacco types may be processed in separate lines. This may be advantageous where the processing steps for some of the tobacco types are different. For example, in conventional primary tobacco processes bright tobaccos and dark tobaccos are processed at least partially in separate processes, as the dark tobacco often receives an additional casing.

However, according to the present invention, preferably, no casing is added to the blended tobacco powder before formation of the homogenized tobacco web.

Further, the method of the invention includes a step 102 of coarse grinding of the tobacco leaves.

According to a variant of the method of the invention, after the tobacco lay down step 101 and before the tobacco coarse grinding step 102, a shredding step 103 is performed, as depicted in FIG. 2. In the shredding step 103 the tobacco is shredded into strips having a mean size comprised between about 1 millimetre and about 100 millimetres.

Preferably, after the shredding step 103, a step of removal of non-tobacco material from the strips is performed (not depicted in FIGS. 1 and 2), for example a metal removal step.

Subsequently, the shredded tobacco is transported towards the coarse grinding step 102. The flow rate of tobacco into a mill to coarse grind the strips of tobacco leaf is preferably controlled and measured.

In the coarse grinding step 102, the tobacco strips are reduced to a first mean particle size of between about 0.3 millimetres and about 1.2 millimetres. At this stage, the tobacco particles are still with their cells substantially intact and the resulting particles do not pose relevant transport issues.

Preferably, after the coarse grinding step 102, the tobacco particles are transported, for example by pneumatic transfer, to a blending step 104. In the blending step 104, some of the coarse ground tobacco particles of the different tobacco types selected for the tobacco blend are blended in order to form the desired first tobacco powder blend. The blending step 104 therefore is a single step for all the selected tobacco types. This means that after the step of blending there is only need for a single process line for all of the different tobacco types which are included in the first tobacco blend.

In the blending step 104, preferably mixing of the various tobacco types in particles is performed. Preferably a step 112 of measuring and controlling one or more of the properties of the first tobacco powder blend is performed. This control is detailed below.

Figure 4:
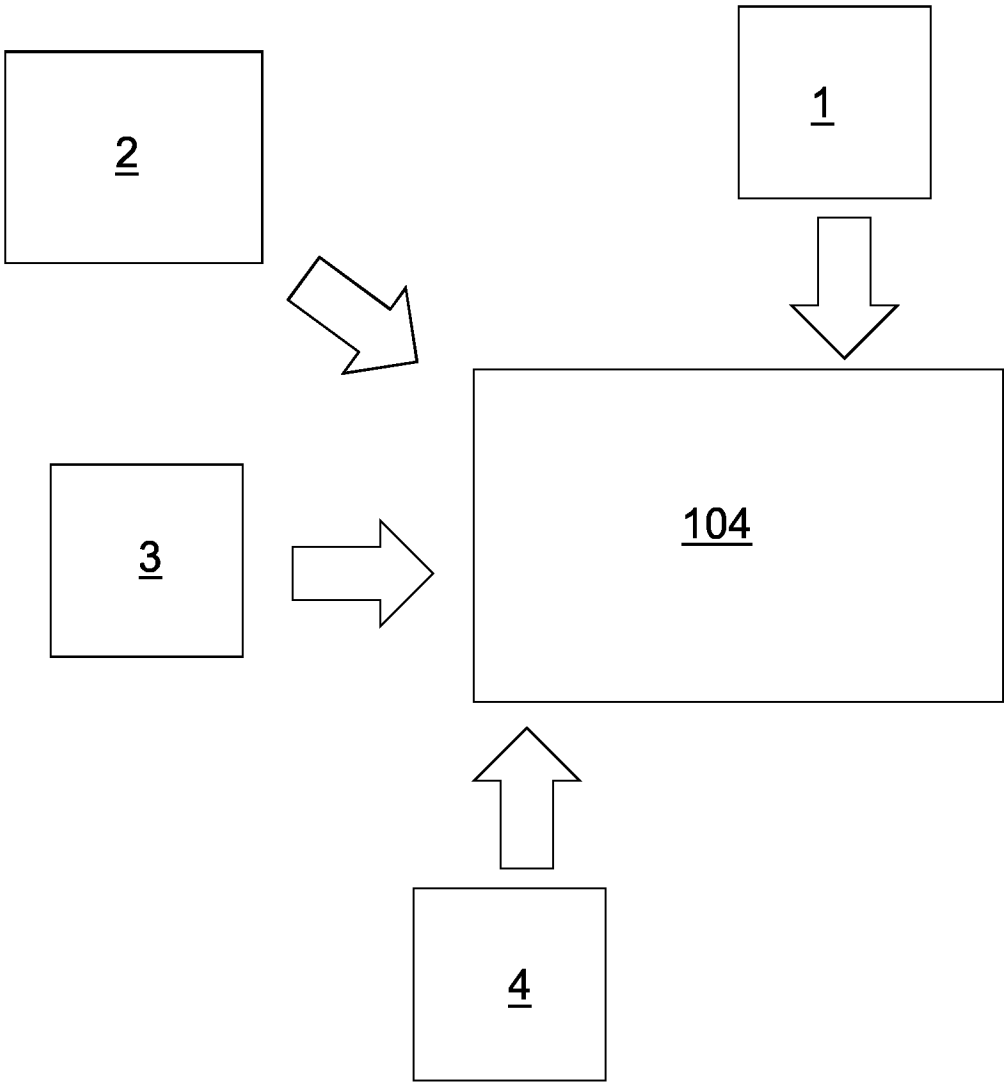
FIG. 4 shows an enlarged view of one of the steps of the method of FIG. 1, 2 or 3.

In FIG. 4, the introduction of the various tobacco types, in this specific example four different tobacco types named 1, 2, 3 and 4, during the blending step 104 is shown. In this way a first tobacco powder blend is formed. It is to be understood that each tobacco type could be itself a sub-blend, in other words, the "bright tobacco type" could be for example a blend of Virginia tobacco and Brazil flue-cured tobacco of different grades.

In the blending step 104, a target value is set for a first characteristic of the resulting first tobacco powder blend. This first characteristic is for example the amount of nicotine or of ammonia present in the first tobacco powder blend before the realization of a slurry for the homogenized tobacco material, so that the target value is the desired level of nicotine or ammonia present in the homogenized tobacco material.

After the blending step 104 and the measuring and controlling step 112, a fine grinding step 105, to a tobacco powder mean size of between about 0.05 millimetres and about 0.15 millimetres is performed. This fine grinding step 105 reduces the size of the tobacco down to a powder size suitable for the slurry preparation. After this fine grinding step 105, the cells of the tobacco are at least partially destroyed and the tobacco powder may become sticky.

The so obtained tobacco powder can be immediately used to form a tobacco slurry. Alternatively, a further step of storage of the tobacco powder, for example in suitable containers may be inserted (not shown).

Figure 3:
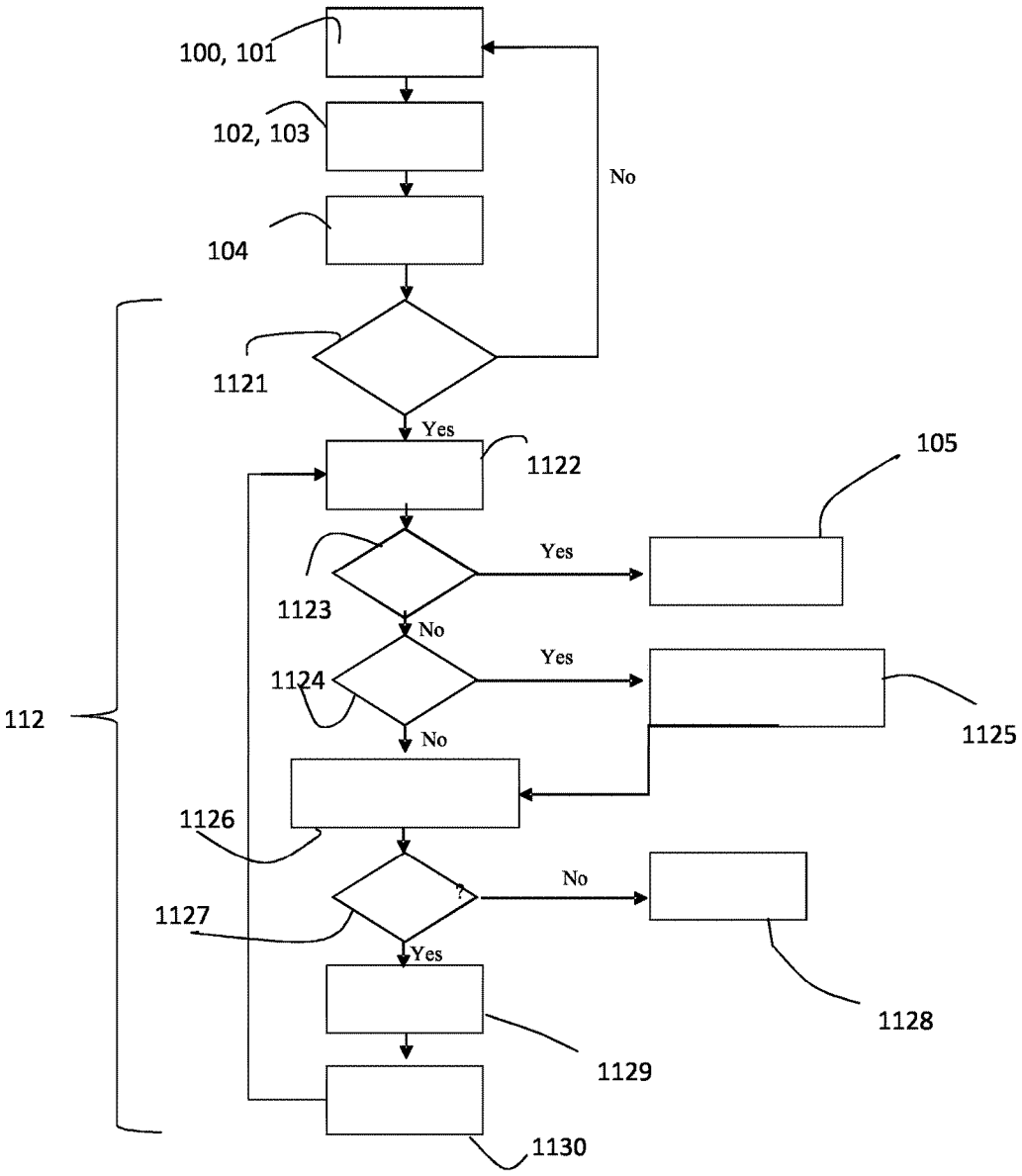
FIG. 3 shows a block diagram of a method for production of a homogenized tobacco material according to the invention.

In FIG. 3, the measuring and controlling step 112 is detailed. In the coarse grinding step 102, preferably each grinded tobacco type arrives into a mixer.

The grinded tobacco powders of the different types remain in the mixer while other bales of tobacco leaves of other types of tobacco which are included in the composition of the wished first tobacco powder blend are also grinded and arrive into the mixer.

This process is carried out up to the point where all the types of tobacco needed to compose the first tobacco powder blend, in the correct relative quantities, are in the mixer. It is indeed checked (step 1121) whether all tobacco types which form the first tobacco powder blend have been introduced into the mixer.

If not, then the introduction continues. If yes, the mixer proceeds to mix its content. Preferably, the mixer works up to the point when there is a homogeneous material in the mixer.

Further, a check is made of the value of the first characteristic, for example of nicotine level or of ammonia level, of the first tobacco powder blend present in the mixer in step 1122. For example, a sample of the mixer content is taken and its levels in specified components (nicotine, ammonia . . . ) are checked.

A comparison in step 1123 with the first target value is thus made. If the value of the first characteristic is equal to the first target value or it is within the desired values interval around the target value, then the production continues with the fine grinding step 105, detailed above.

In case the value of the first characteristic is not equal to the first target value or it is not the desired values interval around the target value, for example the value of the first characteristic is too high or too low, the following takes place.

It is optionally checked whether the mixer is full in step 1124. In case the mixer becomes full, then part of the mixer content is extracted and stored in step 1125, and the following steps are performed on the remaining part, that is, the part of the first tobacco powder blend which remains in the mixer.

If the mixer is not full, or if part of the content of the mixer has been removed in part 1124, then it is checked (step 1126) whether there is a stored tobacco powder of the same blend with an opposite excess of the value of the first characteristic. If this powder exists in the storage (step 1127), this stored tobacco powder is added to the mixer (step 1129).

The selection of the stored tobacco powder used, as well as the quantity of stored tobacco powder added in the mixer, is done by calculating the evaluated value of the first characteristic (1C) in the resulting mix, using standard mean calculation.

For instance:

Final estimated resulting value of the first characteristic=((value of 1C in the mixer)×(quantity of first blend in the mixer in kg)+(value of 1C in the tobacco stored)×(quantity of tobacco stored added in kg))/(quantity of first blend in the mixer+quantity of tobacco stored added)

If such a stored tobacco powder does not exists, the first tobacco powder blend present in the mixer is stored and removed from the mixer (step 1128).

After the stored tobacco powder is added, a mixing step takes place (step 1130). The process then return to step 1122, where a new sample is taken from the content of the mixer, where now a mixture of the first tobacco powder blend and the stored added tobacco powder is present, and the value of the first characteristic is again tested.

If the result is still not substantially equal to the first target value or within a tolerance range around it, the steps 1123-1130 are repeated, till the desired target value for the first characteristic is obtained.

When the desired first characteristic value is obtained, the mixture of tobaccos in the mixer undergoes the fine grinding step 105 and then preferably a slurry is prepared with the finely ground tobacco powder mixture.

Figure 5:
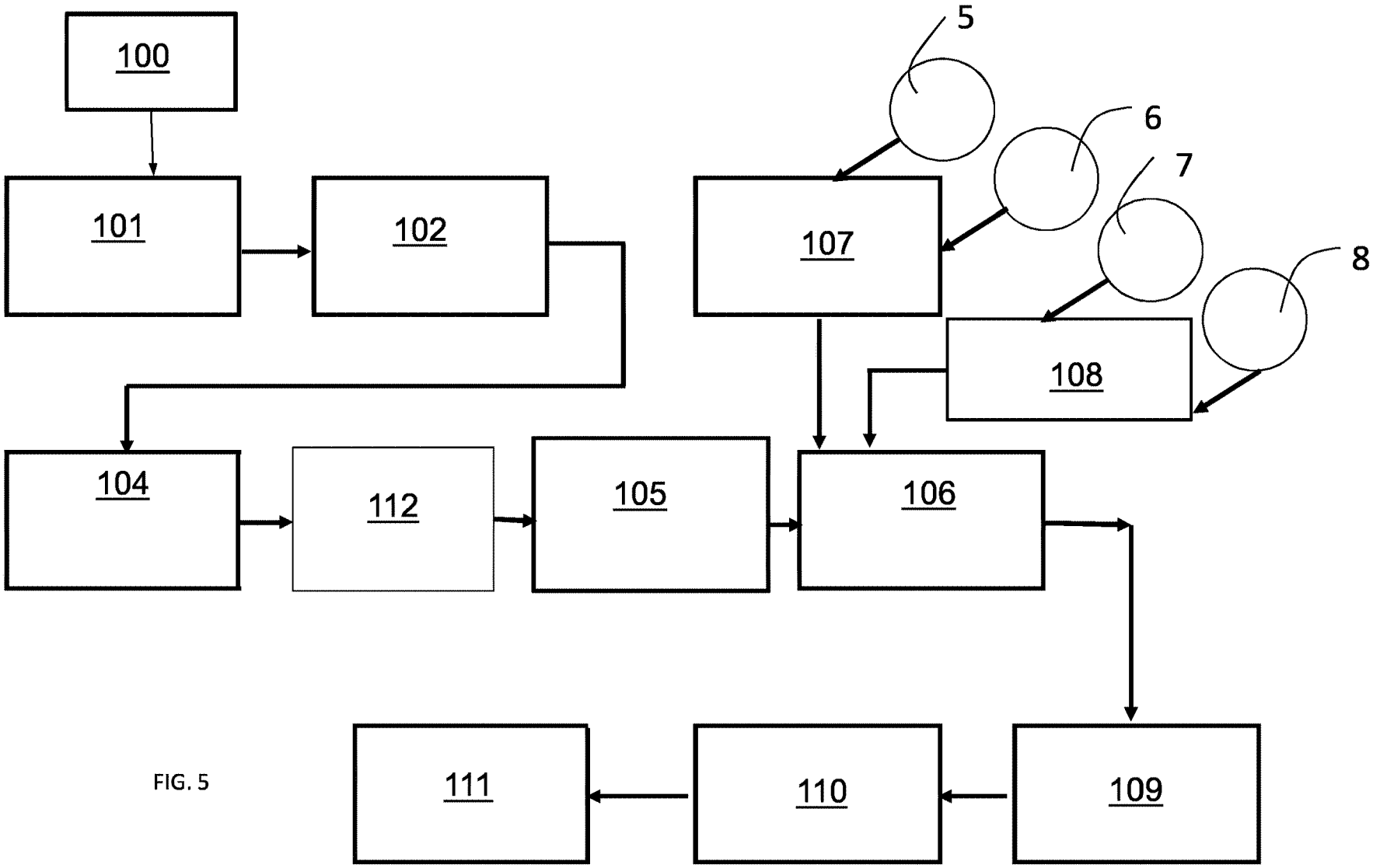
FIG. 5 shows an enlarged view of one of the steps of the method of FIG. 1, 2 or 3.

With now reference to FIG. 5, a method of the invention for a manufacture of a homogenized tobacco web is shown. From step 112, step 105 of fine grinding is realized, and then the tobacco powder blend in the mixer is used in a subsequent slurry preparation step 106. Prior to or during the slurry preparation step 106, the method of the invention includes two further steps: a pulp preparation step 107 where cellulose fibres 5 and water 6 are pulped to uniformly disperse and refine the fibres in water, and a suspension preparation step 108, where an aerosol-former 7 and a binder 8 are premixed. Preferably the aerosol-former 7 includes glycerol and the binder 8 includes guar. Advantageously, the suspension preparation step 108 includes premixing guar and glycerol without the introduction of water.

The slurry preparation step 106 preferably comprises transferring the premix solution of the aerosol-former and the binder to a slurry mixing tank and transferring the pulp to the slurry mixing tank. Further, the slurry preparation step comprises dosing the tobacco powder blend into the slurry mixing tank with pulp, and the guar—glycerol suspension. More preferably, this step also includes processing the slurry with a high shear mixer to ensure uniformity and homogeneity of the slurry.

Preferably, the slurry preparation step 106 also includes a step of water addition, where water is added to the slurry to obtain the desired viscosity and moisture.

In order to form the homogenized tobacco web, preferably the slurry formed according to step 106 is cast in a casting step 109. Preferably, this casting step 109 includes transporting the slurry to a casting station and casting the slurry into web having a homogenous and uniform film thickness on a support.

Preferably, during casting, the cast web thickness, moisture and density are controlled immediately after casting and more preferably are also continuously monitored and feedback-controlled using slurry measuring devices during the whole process.

The homogenized cast web is then dried in a drying step 110 comprising a uniform and gentle drying of the cast web, for example in an endless, stainless steel belt dryer. The endless, stainless steel belt dryer may comprise individually controllable zones. Preferably the drying step comprises monitoring the cast leaf temperature at each drying zone to ensure a gentle drying profile at each drying zone and heating the support where the homogenized cast web is formed.

Preferably, the drying profile is a so called TLC drying profile.

At the conclusion of the web drying step 110, a monitoring step (not shown) is executed to measure the moisture content and number of defects present in the dried web.

The homogenized tobacco web that has been dried to a target moisture content is then preferably wound up in a winding step 111, for example to form a single master bobbin. This master bobbin may be then used to perform the production of smaller bobbins by slitting and small bobbin forming process. The smaller bobbin may then be used for the production of an aerosol-generating article (not shown).

Figure 7:
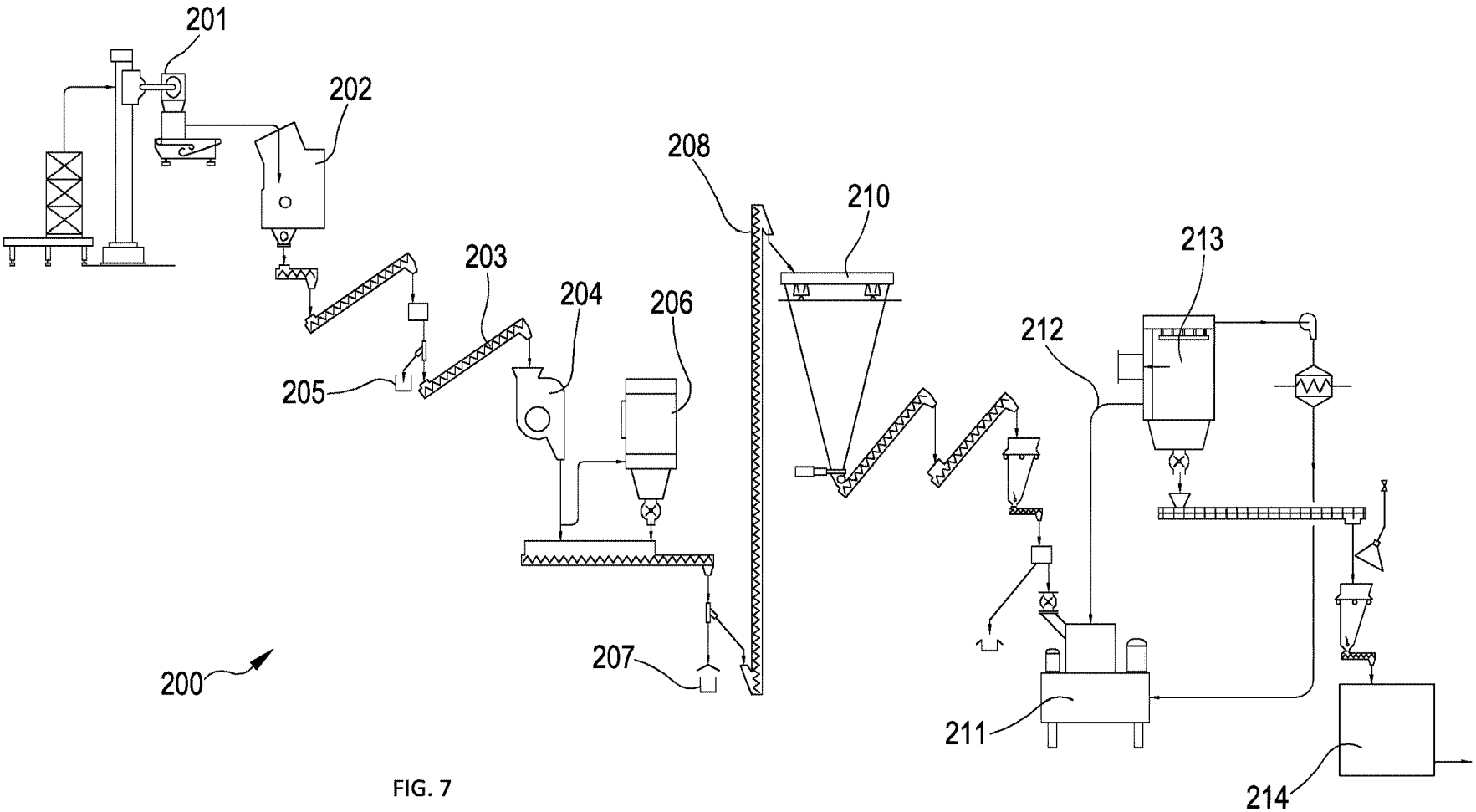
FIG. 7 shows a schematic view of an apparatus for performing the method of FIG. 3.

The method of production of a slurry for the homogenized tobacco material according to FIG. 1 or 2 is performed using an apparatus for the production of a slurry 200 depicted schematically in FIG. 7. The apparatus 200 includes a tobacco receiving station 201, where accumulating, destacking, weighing and inspecting the different tobacco types takes place. Optionally, in case the tobacco has been shipped into cartons, in the receiving station 201 removal of cartons containing the tobacco is performed. The tobacco receiving station 201 also optionally comprises a tobacco bale splitting unit.

In FIG. 7 only a production line for one type of tobacco is shown, but the same equipment may be present for each tobacco type used in the homogenised tobacco material web according to the invention. Further the tobacco is introduced in a shredder 202 for the shredding step 103. Shredder 202 can be for example a pin shredder. The shredder 202 is preferably adapted to handle all sizes of bales, to loosen tobacco strips and shred strips into smaller pieces.

The shreds of tobacco in each production line are transported, for example by means of pneumatic transport 203, to a mill 204 for the coarse grinding step 102. Preferably a control is made during the transport so as to reject foreign material in the tobacco shreds. For example, along the pneumatic transport of shredded tobacco, a string removal conveyor system, heavy particle separator and metal detector may be present, all indicated with 205 in the appended drawing.

Mill 204 is adapted to coarse grind the tobacco strips up to a size of between about 0.3 millimetres and about 1.2 millimetres. The rotor speed of the mill can be controlled and changed on the basis of the tobacco shreds flow rate.

Preferably, a buffer silo 206 for uniform mass flow control, is located after the coarse grinder mill 204. Furthermore, preferably mill 204 is equipped with spark detectors and safety shut down system 207 for safety reasons.

From the mill 204, the tobacco particles are transported, for example by means of a pneumatic transport 208, to a blender 210. Blender 210 preferably includes a silo in which an appropriate valve control system is present. In the blender, all tobacco particles of all the different types of tobacco which have been selected for the predetermined blend are introduced. In the blender 210, the tobacco particles are mixed to a uniform blend. From the blender 210, the blend of tobacco particles is transported to a fine grinding station 211.

Figure 6:
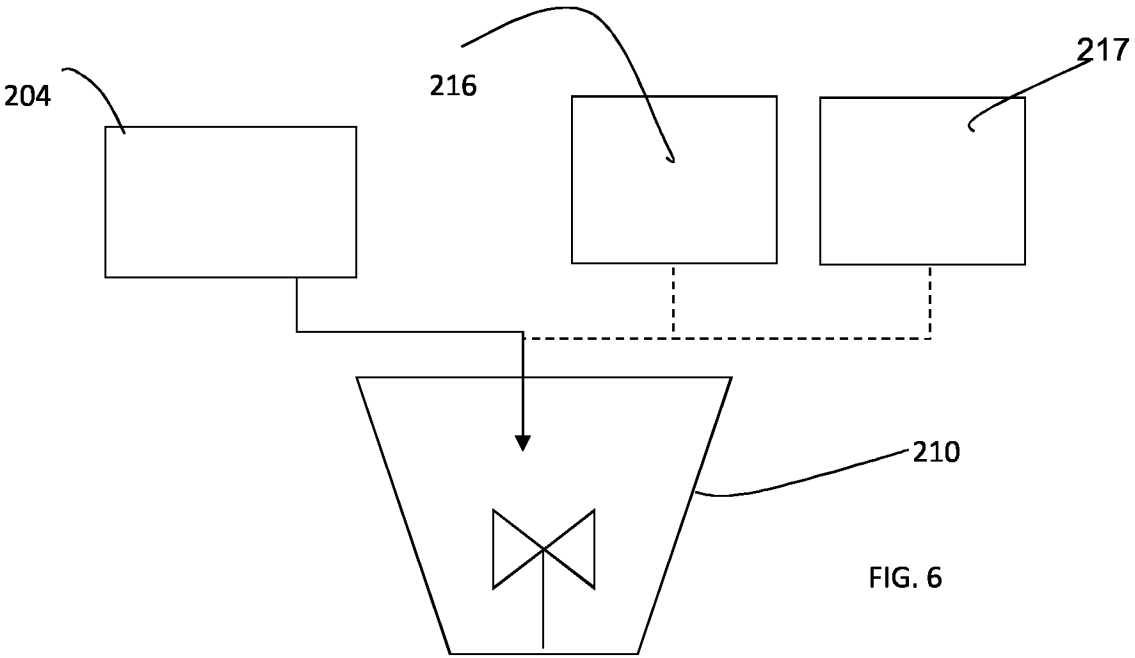
FIG. 6 shows a schematic view of an apparatus for performing the method of FIGS. 1 and 2.

Blender 210 is depicted in an enlarged view in FIG. 6. The blender 210 receives the tobacco powder of different types from the mill 204. Further, the blender 210 is connected to several storage tobacco powder unit, in the drawings only two are depicted 216, 217. The two depicted tobacco powder units include one a tobacco powder having a value of the first characteristic below the target value, and the other one a tobacco powder having a value of the first characteristic above the target value. The tobacco powder contained in units 216, 217 can be used to adjust the value of the first tobacco characteristic of the tobacco powder inside the blender 210 as detailed in step 112.

Fine grinding station 211 is for example an impact classifying mill with suitable designed ancillary equipment to produce fine tobacco powder to the right specifications, that is, to a tobacco powder between about 0.05 millimetres and about 0.15 millimetres. After the fine grinding station 211, a pneumatic transfer line 212 is adapted to transporting the fine tobacco powder to a buffer powder silo 213 for continuous feed to a downstream slurry batch mixing tank where the slurry preparation process takes place.

Figure 8:
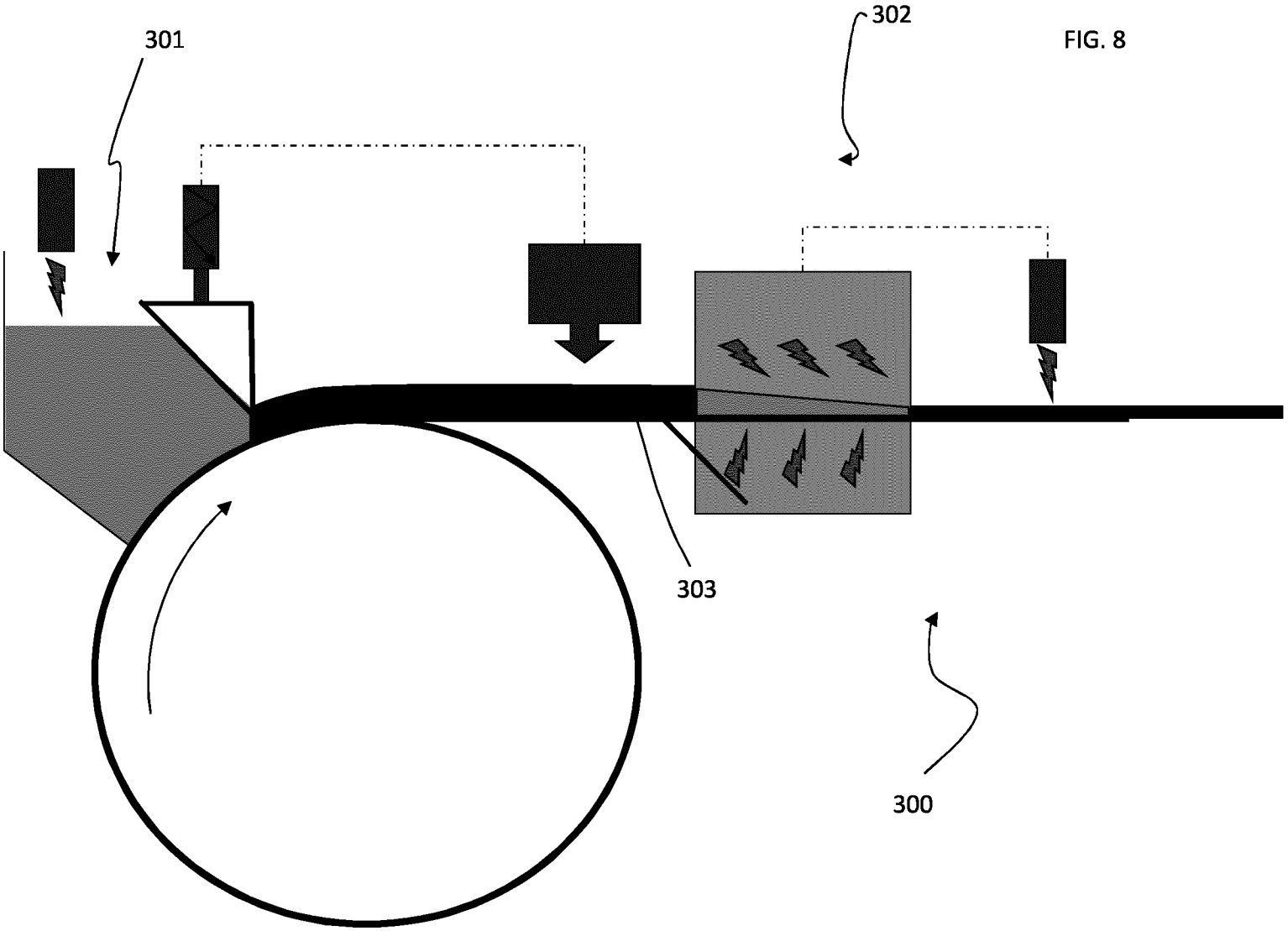
FIG. 8 shows a schematic view of a casting system.

The slurry which has been prepared using the tobacco powder above described in steps 100-109 and 112 of the method of the invention is preferably also cast in a casting station 300 as depicted in FIG. 8.

Slurry from a buffer tank (not shown), is transferred by means of suitable pump with precision flow rate control measurement to the casting station 300. Casting station 300 comprises preferably the following sections. A precision slurry casting box and knife assembly 301 where slurry is cast onto a support 303, such as a stainless steel belt with the required uniformity and thickness for proper web formation, receives the slurry from the pump. A main dryer 302, having drying zones or sections is provided to dry the cast tobacco web.

Preferably, the individual drying zones have steam heating on the bottom side of the support with heated air above the support and adjustable exhaust air control. Within the main dryer 302 the homogenized tobacco web is dried to desired final moisture on the support 303.

The invention claimed is:

1. A method for producing homogenized tobacco material, comprising the steps of:

selecting a first target value for a first tobacco characteristic;

separately grinding different tobacco types so as to obtain a plurality of different ground tobacco powders;

blending at least two of the plurality of different ground tobacco powders so as to form a first tobacco powder blend;

blending at least two of the plurality of different ground tobacco powders so as to form a second tobacco powder blend;

checking a value of the first tobacco characteristic in the first tobacco powder blend;

if the value of the first characteristic of the first tobacco powder blend is different from the first target value, adding the second tobacco powder blend to the first tobacco powder blend in order to obtain a value of the first tobacco characteristic in a mixture of the first and the second tobacco powder blends different from the value of the first tobacco characteristic in the first tobacco powder blend; and adding the second tobacco powder blend while mixing the first tobacco powder blend.

2. The method according to claim 1, wherein the step of modifying a value of the first tobacco characteristic in the mixture includes bringing the value of the first tobacco characteristic in the mixture of the first and the second tobacco powder blends near the first target value.

3. The method according to claim 1, wherein the second tobacco powder blend has a value of the first characteristic different from the value of the first characteristic in the first powder tobacco blend.

4. The method according to claim 3, wherein, if the value of the first characteristic of the first tobacco powder blend is higher than the first target value, the method comprises the step of adding a second tobacco blend having a first characteristic value lower than said first target value; or if the value of the first characteristic of the first tobacco powder blend is lower than the first target value, the method comprises the step of adding a second tobacco blend having a first characteristic value higher than said first target value.

5. The method according to claim 1, wherein said first tobacco characteristic is the amount of reducing sugars, total alkaloids or total ammonia in dry weight basis of the total amount of tobacco present within the homogenized tobacco material.

6. The method according to claim 1, comprising:

checking a value of the first tobacco characteristic after the addition of said second tobacco powder blend, and, if the value of the first tobacco characteristic of the mixture of the first and the second tobacco powder blends is within a tolerance range around the first target value:

i. forming a slurry comprising the mixture; and ii. forming a sheet of homogenous tobacco material from the slurry.

7. The method according to claim 1, wherein adding the second tobacco powder blend comprises adding a second tobacco powder blend including the same tobacco types in substantially the same proportions as in the first tobacco powder blend.

8. The method according to claim 1, wherein said step of grinding different tobacco types so as to obtain a plurality of different ground tobacco powders includes:

coarse grinding different tobacco types so as to obtain a plurality of different coarse ground tobacco powders having a first mean powder size; and fine grinding the mixture of the first tobacco powder blend and the second tobacco powder blend so as to obtain the mixture of the first and the second tobacco powder blends having a second mean powder size smaller than the first mean powder size.

9. The method according to claim 1, wherein, before the step of separately grinding different tobacco types, it includes:

separately shredding the different tobacco types so as to obtain a plurality of different tobacco strips having a third mean strip size.

10. The method according to claim 8, wherein said first mean powder size is smaller than said third mean strip size.

11. The method according to claim 8, wherein the first mean powder size is comprised between about 300 microns and about 1200 microns.

12. The method according to claim 8, wherein the second mean powder size is comprised between about 50 microns and about 150 microns.

13. The method according to claim 1, wherein an amount of the mixture of the first and second tobacco powder blends is comprised between about 20 percent and about 93 percent in dry weight basis of the homogenized tobacco material.

14. The method according to claim 1, wherein the steps of:

blending the different ground tobacco powders so as to form a first tobacco powder blend;

mixing the first tobacco powder blend;

include:

inserting the different ground tobacco powders of different tobacco types into a mixer to form the first tobacco powder blend;

checking a level reached by the first tobacco powder blend in the mixer;

and if the level of the first tobacco powder blend in the mixer is above a threshold level, removing part of the first powder tobacco blend from the mixer before adding the second tobacco powder blend.

15. The method according to claim 4, including the step of drying the sheet of homogenous tobacco material.

16. The method according to claim 1, comprising:

detecting the presence of possible metal objects.

17. The method according to claim 1, wherein the step of mixing the first and the second powder tobacco blends includes mixing the first and the second powder tobacco blend for a time interval comprised between about 5 minutes and about 480 minutes.

18. The method according to claim 1, including the step of:

storing the first tobacco powder blend if a second tobacco powder blend having proper characteristics to modify a value of the first tobacco characteristic in a mixture of the first and the second tobacco powder blends with respect to the value of the first characteristic in the first tobacco powder blend is not available.

* * * * *